US011672324B2

(12) United States Patent
Tejeda

(10) Patent No.: US 11,672,324 B2
(45) **Date of Patent: *Jun. 13, 2023**

(54) HEADREST SUSPENSION SYSTEM

(71) Applicant: Evelyn Tejeda, Boynton Beach, FL (US)

(72) Inventor: Evelyn Tejeda, Boynton Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/646,893

(22) Filed: Jan. 4, 2022

(65) Prior Publication Data

US 2022/0211164 A1 Jul. 7, 2022

Related U.S. Application Data

(60) Provisional application No. 63/133,589, filed on Jan. 4, 2021.

(51) Int. Cl.
*A45F 3/22* (2006.01)
*A47G 9/10* (2006.01)

(52) U.S. Cl.
CPC . *A45F 3/22* (2013.01); *A47G 9/10* (2013.01)

(58) Field of Classification Search
CPC ..... A45F 3/22; A47G 9/10; A47G 9/1009; A47C 16/00
USPC ..... 248/118; 5/636
See application file for complete search history.

(56) References Cited

U.S. PATENT DOCUMENTS 808,217 A * 12/1905 Reich ..... A47G 9/1009 5/643
2,551,727 A * 5/1951 Costello ..... A61G 7/072 5/643
2,581,802 A * 1/1952 Lyons ..... A47G 9/1009 5/643
2,634,435 A * 4/1953 Leighton ..... A47G 9/1054 5/643
2,695,415 A * 11/1954 Holton ..... A47D 15/003 5/643
2,722,693 A * 11/1955 Wolf ..... A47C 20/027 5/426
2,774,079 A * 12/1956 Flatley ..... A61G 7/1055 108/147
3,108,290 A * 10/1963 Partridge ..... A61G 7/1055 5/88.1
4,570,275 A * 2/1986 Merriman ..... A61G 7/0501 248/175

(Continued)

FOREIGN PATENT DOCUMENTS

JP 2005323633 A * 11/2005

*Primary Examiner* — Myles A Throop

(57) ABSTRACT

A recumbent head support system serving as a sleep pillow alternative comprising a frame which suspends a fabric platform and allows the user to customize a height level of support without having to lift their head off the support. In one embodiment, the headrest suspension frame includes a base cross support member, a pair of lower horizontal base members secured to base cross support member, a pair of vertical members secured to base cross member or horizontal base members, and an upper pair of rotatable horizontal members secured to upper terminal ends of fore-end vertical members and arced vertical members which connect upper and lower horizontals, and a fabric sling attached to upper rotatable horizontal members.

12 Claims, 1 Drawing Sheet

(56) References Cited

U.S. PATENT DOCUMENTS

| | | | | | |
|---|---|---|---|---|---|
| 4,843,665 | A * | 7/1989 | Cockel | A61G 7/0005 | 5/81.1 R |
| D318,735 | S * | 7/1991 | Draxler | 5/636 | |
| 5,054,140 | A * | 10/1991 | Bingham | A61G 7/0573 | 5/600 |
| 5,337,429 | A * | 8/1994 | Tucker | A47G 9/1009 | 5/636 |
| 5,360,258 | A * | 11/1994 | Alivizatos | A47D 13/107 | 5/655 |
| 6,581,226 | B1 * | 6/2003 | Brustein | A47G 9/1063 | 5/636 |
| 7,293,303 | B2 * | 11/2007 | Worrell | A61G 7/1032 | 5/81.1 R |

* cited by examiner

HEADREST SUSPENSION SYSTEM

CROSS-REFERENCE TO RELATED APPLICATION

This application claims priority to U.S. Provisional Patent Application No. 63/133,589, filed Jan. 4, 2021, the entirety of which is incorporated herein by reference thereto.

FIELD

The present invention relates generally to headrests and pillows, and, more specifically, to a headrest suspension system having a sling fabric platform and frame that may be adjustable or fixed.

BACKGROUND

Beds and pillows are well known in the art. Their early existence in the U.S. Patent and Trademark Office is evidenced by their inclusion in Class 5 of the old U.S. Patent Classification that includes devices ordinarily known as beds, examining tables, operating tables, hammocks, cradles, cribs, cots, camp beds, ground mats, sleeping bags, and bed accessories, such as mattresses, pillows, surgical supports, and bed clothing.

Pillows have evolved into many forms, and it has been shown that the best position for an individual's head and neck is a pillow that supports the curve of the neck, such that when a user is sleeping on their back, their head and neck reflect the same good posture as when standing. However, many attempts to encourage proper head and neck positioning when sleeping restrict him/her from sleeping on his/her side or stomach.

U.S. Pat. No. 2,581,802 to Lyons discloses a sling headrest that generally comprises a frame and a fabric or flexible material slung between the elevated, longitudinally extending frame members as a sling for a user's head. The frame includes a pair of the base members extending from a fore end of the frame and a connecting lateral crossmember. Vertical fore frame members are 2 connected to the opposing longitudinal base members. Each pair of vertical fore-frame members bend or rotate as much as 90° from the vertical plane established by the vertical fore-frame members.

U.S. Pat. No. 6,581,226 to Brustein discloses an open frame pillow and a pillow support system. The pillow support system generally comprises a frame and includes an open pillow slipcover suspended vertically above the mattress. The frame includes opposing vertical fore-frame members, opposing longitudinally extending base frame members attached at their fore-end to the vertical members, and upper, longitudinally extending opposing frame members. These frame members do not move with respect to each other.

Chinese published patent disclosure CN 213721190 to Du discloses a collapsible, height adjustable pillow frame that is arranged to hold a headrest slung on the elevated longitudinally extending frame members. The pillow frame includes opposing lateral crossmembers, opposing longitudinally extending lower members, opposing vertically extending fore-frame members, and opposing longitudinally extending upper frame members. Each of these members include slots that are arranged to accept and/or connect the frame members to adjacent crossmembers or to connect a member to a connector joint. The lower, cross and upper frame members appear to have a singular slot arranged to connect the members to a respective connector joint or and adjacent member. The upper connecting joints appear to have multiple slots at 90° angles with respect to each other allowing the upper connectors and the upper longitudinal frame members to be rotated 90° with respect to the vertical fore frame members. A sling is arranged to provide a headrest support between the upper, longitudinally extending frame members.

One problem with prior art systems is that they are normally not adjustable to accommodate different sized individuals needing different height settings and levels of support during sleep repositioning.

Thus, there is a need fora recumbent headrest that offers the ease of adjustability to maintain proper curvature of the cervical spine while the head is rested on the support system, for example, after repositioning from supine to side-lying and back. Easy access to change and control the level of head support after repositioning minimizes sleep disturbance. Another concern with prior art headrest systems is that the frames are not collapsible which, when not in use, makes it more difficult to hide on a bed or stow.

SUMMARY

The invention provides a sling headrest suspension system that overcomes the herein fore-mentioned disadvantages of the heretofore-known devices and methods of this general type.

In general, the headrest suspension system is a recumbent head support system that consists of a frame which suspends a fabric platform. Its function is to support the head when the user is in the recumbent positions of supine (lying on one's back, face up), lying on his or her side, or prone (lying on one's stomach, face down). It allows the user to rotatably adjust the height and level of support in a controlled and easily accessible manner to meet their anatomical, cervical spine alignment needs. When the head is supported with the cervical spine in normal anatomical alignment, there is decreased stress on the surrounding ligaments and vertebral discs, in turn, promoting relaxation of the local postural muscles and minimizing restlessness.

One concern this headrest addresses relates to customization. Most bed pillows are not adjustable, and users compensate for the lack of customization by attempting to puff up or fold the pillow, using more than one pillow to achieve the needed height, or they end up using their arms or hands to cradle their head to attain the needed support. This may compress body parts and restrict blood flow, including sensitive areas like the carotid sinus and blood vessels on the side of the neck.

Unlike standard bed pillows, the headrest system of the present invention offers ease of adjustability for height of support, surface area covered/weight-bearing distribution, and shifting of pressure point.

The present invention provides a device that offers an actuated control element to rotatably adjust the sling fabric's platform by increasing or decreasing the tension or laxity, in turn, the slack or droop or degree of concave support, meeting the user's need for support and comfort.

This headrest also addresses a potential concern relating to off gassing of volatile organic compounds (VOCs). The flexible fabric sling material, hung between upper, longitudinally extending frame elements, is made of materials void of potentially toxic emissions. This is important considering the proximity of one's respiration to the pillow surface. Many of the bed pillows on the market today are made with petroleum based synthetic materials (polyester/polyurethane/memory foams) which do off-gas VOCs. Additionally, some pillows (even some of the natural feather, down or cotton fill pillows) undergo chemical treatments which outgas due to its composition and/or breakdown (flame retardants/antimicrobials/pesticides). Some of these chemicals are considered persistent organic pollutants and hormonal, endocrine disrupting chemicals. Regardless of claims that these VOCs are at low levels, persons should not breathe in these potentially irritating/sensitizing vapors. The headrest's suspension fabrics will be woven using natural materials that do not off-gas VOCs.

The headrest will provide a breathable rest surface, minimizing the retention of body heat. The headrest can easily be sanitized. The preferred suspension fabric is an organic cotton material that will be offered in a selection of thicknesses and stretch to accommodate user preferences. The fabric will be easily detachable for cleaning and replacement and is machine washable. It can be cleaned as simply as washing a pillowcase. This is important considering the soil and bodily secretions that accumulate on the sleep striate (e.g., saliva, sweat, dead skins cells, natural skin oils, skin products). Regular washing of the fabric minimizes concerns with allergens such as dust mites or respiratory pathogens such as mold, bacteria, and viruses. Also, there is less risk for bed bug infestation.

The headrest frame can be easily wiped clean and is collapsible for stowing. The headrest can be made as a sustainable product.

The user has an option of resting his or her head directly on the fabric platform sling material or adding their favorite pillow on top of the sling and adjusting the platform height to meet a desired comfort level. In the side-lying position, the lower arm of the sleeper can rest freely under the headrest, and the upper arm of the sleeper may be placed on the fabric platform which facilitates chest expansion and minimizes stress on the upper back muscles/spine.

The headrest suspension system's frame is freestanding where it sits atop the bed or other sleeping surface and has safety features to decrease risk of personal injury.

Although the invention is illustrated and described herein as embodied in a sling headrest suspension system, it is, nevertheless, not intended to be limited to the details shown because various modifications and structural changes may be made therein without departing from the spirit of the invention and within the scope and range of equivalents of the claims. Additionally, well known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which, can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically: The term "providing" is defined herein in its broadest sense, e.g., bringing/coming into physical existence, making, available, and/or supplying to someone or something, in whole or in multiple parts at once or over a period of time.

In the description of the embodiments of the present invention, terms such as "first," "second," "third" and so on are only used for descriptive purposes and cannot be construed as indicating or implying relative importance.

In order to describe aspects of the present invention, the term "fore" refers to frame elements near or adjacent the head of the bed and hence, the sling fabric itself, is near the headboard of the user's bed (near or at the top of the user's head or skull). The rotation or angular movement of various inventive components may be discussed in relationship with x, y and z coordinates forming the sling frame.

At the terminal end of upper opposing frame elements, a controllable element enables the user to adjust the platform depth or concave size, and hence the tension, of the sling fabric or material by either rotating the control in the prescribed direction to tighten or reduce the concave condition of the suspended sling fabric or to move the controlled end to loosen or increase the concavity of the salon fabric.

The upper opposing frame members provide support for the slung fabric. These upper longitudinally extending frame members provide a foundation for the slung fabric which wraps around each frame member. The control mechanisms near the terminal end of the upper frame members allows both clockwise and counterclockwise rotational adjustment of the slung fabric. For example, the degree of concave suspension provided by the system is reduced when the right-side terminal end control is rotated clockwise and the left side terminal control is rotated counterclockwise or vice versa. These rotational controls increase or decrease the slack, laxity and suspension of the bridge—like suspended slung fabric. This function, in turn, serves to increase or decrease the support height, the weight-bearing surface area of support, that is, the load distribution, and shifting of pressure point.

The lateral span of the upper frame members or elements may be adjustable, as described later, or may be fixed with a minimum 24-inch lateral span similar to typical pillow widths such as the Standard 26-inch pillow. The longitudinal span or length of the upper frame members, in one embodiment, is approximately 16 inches. In a preferred embodiment, the anterior aspect (longitudinally displaced from the vertical fore-end plane defined, by opposing vertical frame elements), is slightly angled medially approximately 5 degrees when receiving a weight-bearing loadt to decrease slung fabric tension, that is, to increase laxity, and to minimize compressive forces on the user's neck and lower facial area. Similarly, the upper horizontal frame members are slightly angled downward from the upper vertical members to decrease compressive forces on the user's neck and lower facial area.

In a further modification, the fore-end vertical frame members need not be straight nor disposed in a singular vertical plane.

In a further embodiment of the present invention, the frame system may include one or more fore-end cross members laterally spanning distance y and being connected to opposing vertical fore-end frame members. In one embodiment, the lateral span of the system is about 24 inches. A minimum of one cross member support 4 is positioned along the opposing vertical fore-end frame elements. The single cross support member 4 may be positioned at the top or bottom of opposing fore-end vertical frame elements 3, 3 or any functional level along the opposing vertical fore-end frame members.

The suspension fabric may be a cloth fabric with a variable stretch function that is attached to or suspended between the opposing upper longitudinal frame elements 2, 2. It is contemplated, in one embodiment, that the longitudinal span of the slung fabric will be approximately 13 inches.

Typically, the weight of an adult user's head is about 8-12 pounds. However, the sling frame may account for the weight of a user's arm and the nominal weight of the pillow. The vertical height of a user's head is about 10 inches, and the lateral span of a typical adult user head is about 6.5 inches. A typical broad-shouldered adult has about a 20-inch lateral shoulder span than from left to right shoulder joint.

BRIEF DESCRIPTION OF THE DRAWINGS

Further objects and advantages of the present invention can be found in the detailed description of the invention. Various embodiments are disclosed, by way of example only, with reference to the accompanying schematic drawings in which corresponding reference symbols indicate corresponding parts.

DETAILED DESCRIPTION

At the outset, it should be appreciated that like drawing numbers on different drawing views identify identical, or functionally similar, structural elements. It is to be understood that the claims are not limited to the disclosed aspects. Furthermore, it is understood that this disclosure is not limited to the particular methodology, materials and modifications described and as such may, of course, vary. It is also understood that the terminology used herein is for the purpose of describing particular aspects only and is not intended to limit the scope of the claims. Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims.

Figure 1:
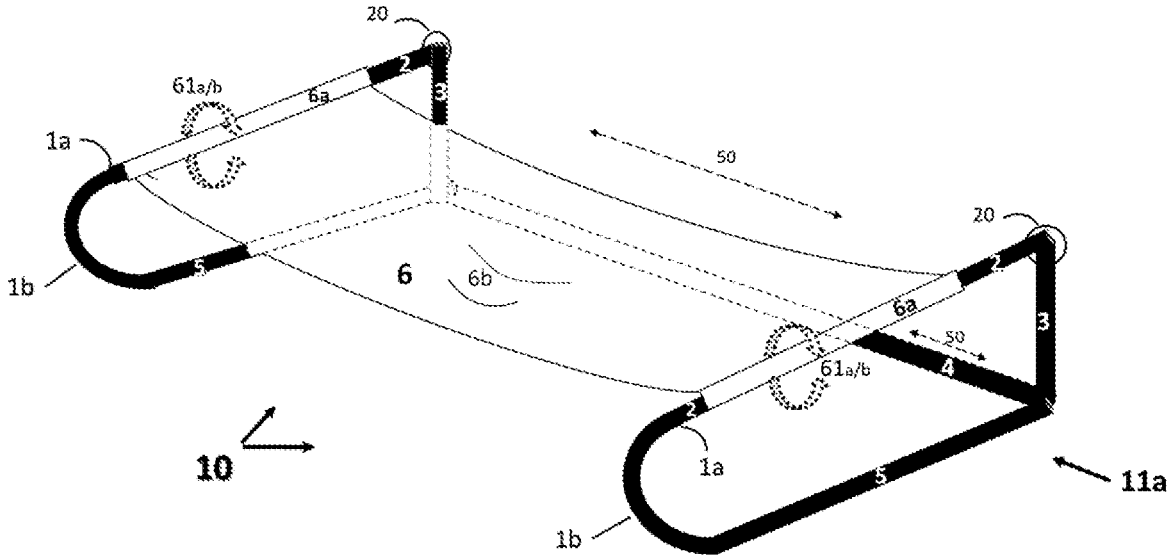
FIG. 1 shows a perspective view of an embodiment of the present invention.

FIG. 1 is a perspective view of a first embodiment of the present invention. Sling headrest suspension system 10 generally comprises two essential components, a sling or bridge or suspended fabric 6, and frame 11*a* Sling 6 is arranged to provide a support for an individual's head when they are laying down, either on their back, sides, or stomach. Sling 6 is a cloth fabric or other flexible material that does not release volatile organic compounds (VOCs). Preferably, sling 6 or slung fabric 6 forms a relatively flat or concave head support platform for the user's head.

The frame system 11*a* includes horizontal upper members 2, 2, which may be tubes, solid rods, or any other suitable member. Longitudinally extending horizontal upper frame members 2, 2 each have two ends, one fore-end engaging a first or upper end of vertical frame members 3, 3. The longitudinal horizontal upper frame members 2, 2, extend slightly pitched downward from the upper portions of vertical frame members 3, 3. Vertical frame members 3, 3 have second or tower ends arranged distally in relation to the first upper ends. Vertical frame members 3, 3 may be tubes, solid rods, or any other suitable member. Vertical frame members 3, 3 have second or lower ends that are secured to first cross base frame support member 4 or in another embodiment not shown, 3, 3 may be secured to first horizontal base members 5, 5 proximal to cross base support 4. Cross base support 4 and vertical frame elements 3, 3 are generally co-planar. Cross support frame member 4 has two ends that are respectively secured to lower horizontal base frame members 5, 5 at the first or fore ends of horizontal base frame members 5, 5.

The opposite terminal ends of the horizontal upper frame members 2, 2 (that is, at the longitudinal extremity of members 2, 2) and the longitudinal terminal ends or second ends of horizontal base lower frame members 5, 5 engage the opposite ends of arced vertical connecting members 1*b*, 1*b*. In other words, arced vertical connecting members 1*b*, 1*b* provide a vertical supporting framework at a distal, longitudinal end of the upper rotatable horizontal frame members 2, 2, because the distal connecting members 1*b*, 1*b* are coupled to the upper and the lower horizontal frame members. Arced vertical connecting members 1*b*, 1*b* may be tubes, solid rods, or any other suitable member that does not have defined edges about its outside perimeter and are preferably configured in an arc shape as to prevent having defined edges that could injure an individual using sling headrest suspension system 10.

Rotatable control connectors 20, 20 connect upper horizontal frame members 2, 2 to the upper terminal end of vertical frame members 3, 3.

Sling or bridge fabric 6 is arranged to allow a user's head to rest on the sling fabric platform. Sling fabric 6 may include loops or channels 6*a* arranged at opposite ends of sling 6. Loops or channels 6*a* are arranged to accept upper longitudinally extending horizontal members 2, 2. When sling fabric 6 is engaged on horizontal upper frame members 2, 2, it creates a suspended fabric platform which may be substantially flat or adjusted to varying levels of droop or concavity 6*b* down to the base level. Sling depression 6*b* or the concave sling fabric or, if the sling is disposed in a substantially flat condition, supports a user's head when sling headrest suspension system 10 is in use. When the user's head is on the fabric and in operational use, some concavity will be established. The laxity or degree of concave sling depression 6*b* of sling fabric 6 may be increased or decreased in depth by the adjustment of control elements 20 and 1*a*.

In this embodiment of sling headrest suspension system 10, the base cross support member 4 may be fixed or expandable to permit lateral adjustment 50.

Figure 2:
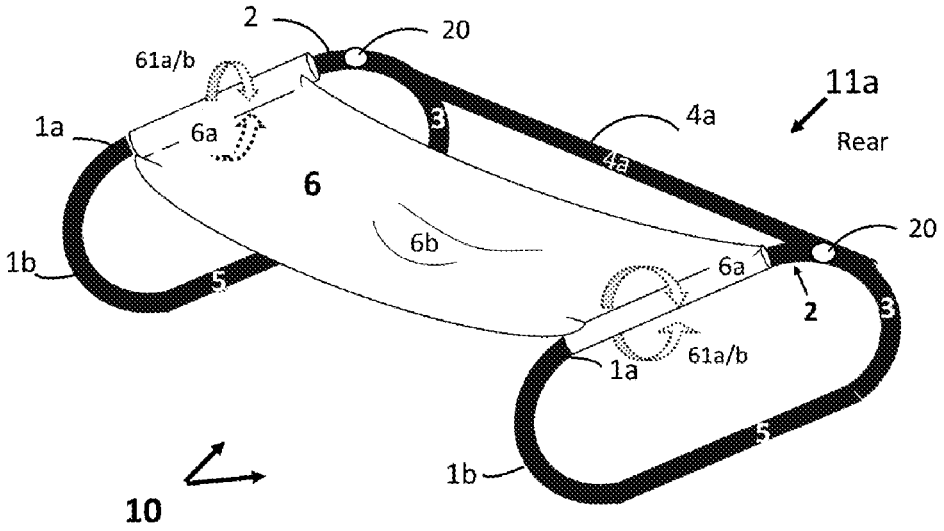
FIG. 2 shows a perspective view of an additional embodiment of the present invention.

FIG. 2 illustrates another embodiment of the present invention. This embodiment includes similar components described in connection with FIG. 1. In this embodiment of sling headrest suspension system 10, the fore-end vertical members 3, 3 are arc shape and the terminal ends of base cross support member 4*a* is secured to arced vertical members 3, 3 approximately midway. Wherein upper horizontal members 2, 2 are rotatably secured to upper terminal end of arced vertical members 3, 3 and arced vertical connectors 1*b*, 1*b*. Lower horizontal base members 5, 5 are secured to lower terminal ends of fore-end arced vertical members 3, 3 and lower terminal end of arced vertical connectors 1*b*, 1*b*.

Certain control elements are discussed herein. At the terminal end of upper opposing frame elements 2, 2, a controllable element 1*a*, 1*a* enables the user to adjust the tension and hence the droop, depth or concave size of the sling fabric or material 6 (otherwise referred to as the laxity of the fabric) by either rotating the control in the direction of arrow 61*a* or 61*b* to either tighten or reduce the droop/concave condition of the sling fabric or to loosen or increase the concavity of the sling fabric, depending on whether the attached sling is rolled over or under the upper horizontal member. In other words, a clockwise or counterclockwise rotation may cause the same effect depending on if the rotation was initiated with an over- or under-hung turn relative to the horizontal member.

A variety of rotational "fabric gathering and fabric loosening" controls may be used. These rotational roll controls permit the user to increase or decrease the slack, laxity and suspension of the bridge—like suspended sling fabric. This roll function, in turn, serves to increase or decrease the support height, weight-bearing surface area of support, that is, the load distribution on the sling, and shifting of pressure point.

The lateral span of the upper frame members or elements (in the y direction) is also adjustable. Each cross-member frame element 4, 4*a* may have control elements to telescopically collapse or expand the lateral span of the system. One type of control element is a spring-loaded button lock which, when the button is placed in laterally displaced holes, the telescopically configured frame elements 4, 4*a* enable the user to select the proper lateral span 50 of the system. The user presses the button down, releasing the spring-loaded button from the first hole, then moves the telescopic tubes relative to each other such that the button snaps into the next selected y positional hole. Other telescopic, releasable and locking systems can be used such a cam-driven twist close, twist open lock.

In a further modification, the fore-end vertical frame members 3, 3 need not be straight nor disposed in a singular vertical plane.

One consideration for a stow-away position is the detachment of the cross support member(s).

What I claim is:

1. A recumbent sling headrest suspension system which serves as a sleep pillow alternative allowing the user to adjust a height level of support without having to lift a user's head off the sling support, comprising:

a frame comprising:

a base cross support member;

a first pair of straight horizontal base members secured to said base cross support member laterally and perpendicular to the base cross support member;

a fore-end pair of vertical members secured to and extending upwardly from lateral ends of said base cross support member or said first pair of horizontal base members proximal to said base cross support member;

a second pair of straight horizontal members rotatably secured to and extending with a slight downward pitch from the upper end of said fore-end pair of vertical members, said second pair of horizontal members are rotatable and arranged parallel to one another;

a pair of arced vertical members secured to and connecting distal ends of said first pair of horizontal base members to the rotatable said second pair of horizontal members; and, a sling-like fabric secured to said pair of rotatable horizontal members.

2. The sling headrest suspension system recited in claim 1 wherein said second pair of horizontal members are rotatably secured to upper ends of said first fore-end pair of vertical members and said second pair of arced vertical members allowing clockwise and counterclockwise rotation to adjust sling fabric tension/droop.

3. The sling headrest suspension system recited in claim 1 wherein said sling fabric extends beyond the span of the rotatable horizontal members such that there is enough slack to allow for rotational adjustment of droop height down to base level as well as provide padding of the rotatable horizontal members.

4. The sling headrest suspension system recited in claim 1 includes at least one user actuated control element adjacent a terminal end of at least one rotatable horizontal member which adjusts the tension, laxity and/or droop of the sling fabric which, in turn, adjusts height level of head support.

5. The sling headrest suspension system recited in claim 1 wherein said base cross support member length has at least a two-foot span between rotatable horizontal members and may be adjustable to wider or narrower spans to adjust surface area/weight distribution of sling support.

6. The sling headrest suspension system recited in claim 1 wherein the distal ends of said first pair and said second pair of horizontal members shift slightly medially/inward upon the introduction of a weight-bearing load onto the sling support.

7. A recumbent sling headrest suspension system which serves as a sleep pillow alternative allowing the user to adjust a height level of support without having to lift a user's head off the sling support, comprising:

a frame comprising:

a base cross support member;

a first, fore-end pair of arced vertical members secured near midsection of arc to said base cross support member at lateral ends;

a first pair of straight horizontal base members secured to lower terminal end of said first, fore-end pair of arced vertical members perpendicular to said base cross support member;

a second pair of straight horizontal members rotatably secured to and extending from the upper terminal end of said first, fore-end pair of arced vertical members with a slight downward pitch, said second pair of horizontal members arranged parallel to one another;

a second pair of arced vertical members secured to and connecting the distal ends of said first pair of horizontal base members to the rotatable said second pair of horizontal members; and a sling-like fabric secured to said pair of rotatable horizontal members.

8. The sling headrest suspension system recited in claim 7 wherein said second pair of horizontal members are rotatably secured to upper ends of said first fore-end pair of vertical members and said second pair of arced vertical members allowing clockwise and counterclockwise rotation to adjust sling fabric tension/droop.

9. The sling headrest suspension system recited in claim 7 wherein said sling fabric extends beyond the span of the rotatable horizontal members such that there is enough slack to allow for rotational adjustment of droop height down to base level as well as provide padding of the rotatable horizontal members.

10. The sling headrest suspension system recited in claim 7 includes at least one user actuated control element adjacent a terminal end of at least one rotatable horizontal member which adjusts the tension, laxity, and/or droop of the sling fabric which, in turn, adjusts the height level of head support.

11. The sling headrest suspension system recited in claim 7 wherein said base cross support member length has at least a two-foot span between rotatable horizontal members and may be adjustable to wider or narrower spans to adjust surface area/weight distribution of sling support.

12. The sling headrest suspension system recited in claim 7 wherein the distal ends of said first pair and said second pair of horizontal members shift slightly medially/inward upon the introduction of a weight-bearing load onto the sling support.

* * * * *